US005447099A

United States Patent [19]

Adams et al.

[11] Patent Number: 5,447,099

[45] Date of Patent: Sep. 5, 1995

[54] HEIGHT ADJUSTMENT MECHANISM FOR TABLES

[75] Inventors: Alan J. Adams, Shelton; Robert J. Ferraro, Monroe; Richard M. LaCouture, Ansonia, all of Conn.; Donald H. Eckloff, Cranford, N.J.

[73] Assignee: Howe Furniture Corporation, Trumbull, Conn.

[21] Appl. No.: 153,149

[22] Filed: Nov. 15, 1993

[51] Int. Cl.[6] ..... A47B 9/00

[52] U.S. Cl. ..... 100/147; 240/188.4

[58] Field of Search ..... 108/147, 144, 146, 148, 108/50; 248/108.2, 188.3, 188.4, 188, 188.1, 188.5

[56] References Cited

U.S. PATENT DOCUMENTS

| | | | |
|---|---|---|---|
| 2,547,296 | 4/1951 | White | 100/144 |
| 2,935,813 | 5/1960 | Berman et al. | 108/144 X |
| 4,593,874 | 6/1986 | Dunagan | 248/188.4 |
| 4,604,955 | 8/1986 | Fleischer et al. | 108/147 |
| 4,667,605 | 5/1987 | Bastian | 108/144 |
| 4,785,742 | 11/1988 | Esslinger | 108/147 X |
| 4,981,085 | 1/1991 | Watt | 108/147 |
| 5,050,829 | 9/1991 | Sykes | 248/188.4 |
| 5,259,326 | 11/1993 | Borgman et al. | 108/147 |
| 5,311,827 | 5/1994 | Greene | 108/147 |

*Primary Examiner*—Jose V. Chen

*Attorney, Agent, or Firm*—Parmelee, Bollinger & Bramblett

[57] ABSTRACT

A height adjustment mechanism for a table top generally comprises two leg assemblies each having a base and two vertical columns, a slidable post assembly on each leg assembly with the slidable post, assemblies supporting the table top, and a drive for raising and lowering the leg assemblies and supported table top. The slidable post assemblies have opposed covers which frictionally engage the vertical posts to hold the table top at an adjusted height. The drive is a lack screw and jack nut in each leg/slidable post assembly, wherein the jack screws are connected by a chain and sprocket drive and are driven by a crank.

20 Claims, 4 Drawing Sheets

HEIGHT ADJUSTMENT MECHANISM FOR TABLES

FIELD OF THE INVENTION

The invention herein relates to a height adjustment mechanism for tables or the like and more particularly to a height adjustment mechanism which utilizes frictional engagement between relatively moveable parts thereof in order to stabilize table support and maintain an adjusted height until further operation of the mechanism.

BACKGROUND OF THE INVENTION

Ergonomics of various tasks, such as reading, writing, drawing, and even sorting and assembly of documents, can be enhanced by having a work station of the proper height. Different tasks are more efficiently performed on different height work surfaces, and workers are also of varying sizes. Also, some workers prefer to perform some tasks standing up, or to combine periods of standing and sitting in their work day.

Accordingly, there is a need for adjustable height work tables. Additionally, the height adjustment mechanism for such tables must be easy to use and is preferably infinitely adjustable as opposed to being lockable at discreet intervals of height. A height adjustment is also more convenient if it does not require the steps of unlocking and locking a position, whereby any desired change in adjustment may be accomplished quickly.

SUMMARY OF INVENTION

Accordingly, a principal object of the invention herein is to provide a height adjustment mechanism for a table.

An additional object of the invention herein is to provide a height adjustment mechanism which maintains the adjusted height until further operation thereof.

It is a further object of the invention herein to provide a height adjustment mechanism for a table which is simple and accurate in its operation.

It is another object of the invention herein to provide a height adjustment mechanism for tables which is of sturdy construction and is easily assembled.

In accomplishing these and other objects of the invention, there is provided a height adjustment mechanism for a tabletop comprising at least one leg assembly including a base and two spaced-apart, vertical columns upstanding from the base, wherein the two vertical columns each have two elongated vertical friction strips which are juxtaposed the elongated vertical friction strips of the other column. The height adjustment mechanism further comprises at least one slidable post assembly including a pair of opposed, connected sliding covers, one cover spanning the space between the two vertical columns and engaging one of the elongated vertical friction strips of each column, and the other cover also spanning the space between the two vertical columns opposite the first cover and engaging the remaining elongated vertical friction strips of each column. The covers are secured together to frictionally clamp against the friction strips of the columns, and the upper ends of the covers are secured to and support the tabletop. The height adjustment mechanism further comprises drive means for driving the slidable post assembly and the tabletop secured thereto up and down to an adjusted height, wherein the clamping frictional engagement between the covers and the vertical columns stabilizes the table support and assists in holding the table at the adjusted height.

According to certain aspects of the invention, the covers are secured together by adjustable, preferably threaded, fasteners to select the frictional clamping force. The covers also advantageously include inturned marginal edges which frictionally engage the corners of rectangular columns. The covers and columns are coated with a finish which provides uniform frictional engagement through the operating range.

According to further aspects of the invention, the drive means includes a gear box having flanges received in notches in the covers to mount and secure the gear box between the covers, and a jack screw depends from-the gear box and extends into a channel member mounted between the vertical columns. A jack nut is secured in the channel member and receives the jack screw for driving the table up and down. A bushing for stabilizing the jack screw is also provided in the channel member. The gear box includes bevel gears and a handle crank operable to adjust the height of the tabletop by driving the jack screw through the bevel gears.

According to additional aspects of the invention, two height adjustment mechanisms are provided as supports for the tabletop, and the second height adjustment mechanism is driven in parallel with the first height adjustment mechanism by connecting drive means.

The various features of novelty which characterize the invention are pointed out with particularity in the claims annexed to and forming a part of the specification. For a better understanding of the invention, its operating advantages, and specific objects attained by its use, reference is made to the accompanying drawings and descriptive matter in which a preferred embodiment of the invention is illustrated.

BRIEF DESCRIPTION OF THE DRAWINGS

With this summary of the invention, a detailed description follows with reference being made to the accompanying drawings which form a part of the specification, of which.

The same reference numerals refer to the same elements throughout the various Figures.

DESCRIPTION OF PREFERRED EMBODIMENT

Figure 3:
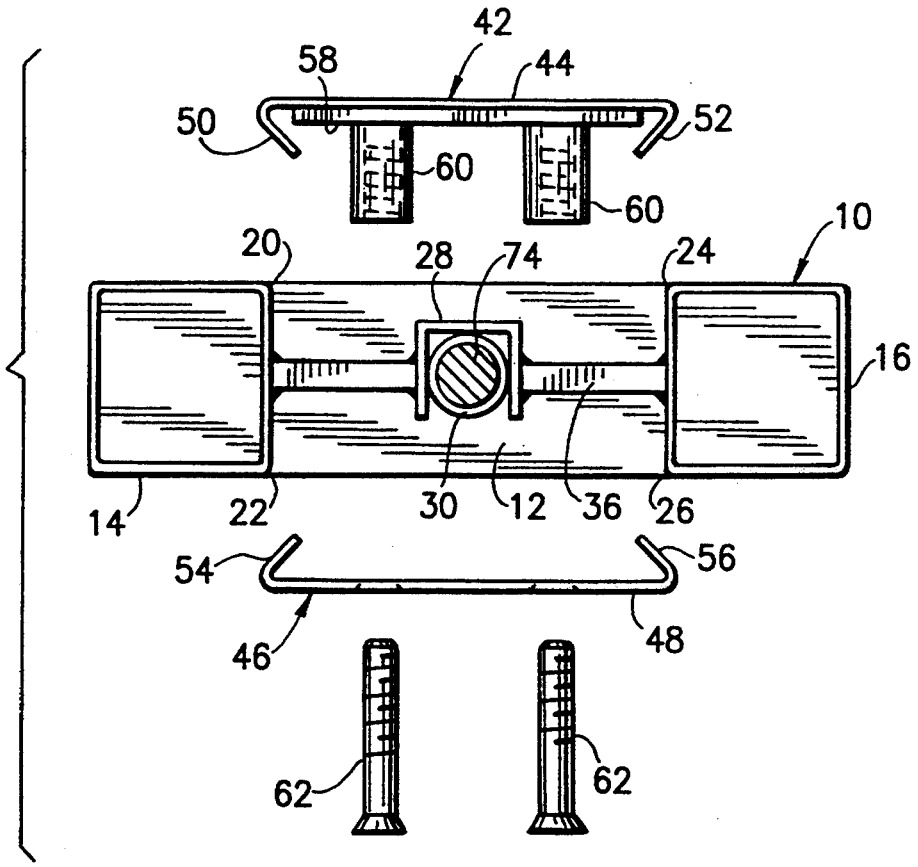
FIG. 3 is a cross sectional view, partially exploded and partially fragmented, of the height adjustment mechanism of FIG. 1, taken along the lines 3—3 of FIG. 2.

A tabletop 1 is supported by a height adjustment mechanism 5 according to the invention herein. The height adjustment mechanism 5 includes a leg assembly 10 having a base 12 in the form of an elongated rectangular tube which may be equipped with glides 13, if desired. The leg assembly 10 further comprises two upstanding parallel spaced apart vertical columns 14 and 16, which have their lower ends secured to the base 12, such as by welding indicated at 18. The vertical columns 14 and 16 are preferably provided with rounded end caps 15 and 17 respectively, primarily for the sake of appearance. The columns 14 and 16 are generally rectangular, and column 14 defines friction strips 20 and 22 on the corners thereof juxtaposed friction strips 24 and 26 defined on the corners of vertical column 16. The location of the friction strips 20, 22, 24 and 26 is best seen in FIG. 3.

The leg assembly 10 further comprises a channel 28 having a C-shaped cross section, with the open side preferably facing inwardly with respect to the edge of the tabletop 1. The channel 28 has a jack nut 30 secured at the upper end thereof, and a bushing 32 mounted further down in the channel. The channel 28 is also secured to the base 12 by welding, as indicated at 34, and is maintained in its position between the vertical columns 14 and 16 by cross braces 36, best seen in FIGS. 2 and 3.

The height adjustment mechanism 5 further comprises a slidable cover assembly 40 including two elongated covers 42 and 46 which generally flank the vertical columns 14 and 16 and substantially enclose the space therebetween. The cover 42 has a generally planar central panel 44 providing an outer surface spanning the space between vertical columns 14 and 16 and cover 46 similarly has a central panel 48 which extends between the vertical columns 14 and 16 on the opposite side from the cover 42. In the preferred embodiment illustrated herein, the cover 42 has in-turned marginal edges 50 and 52, and cover 46 has in-turned marginal edges 54 and 56. Cover 42 is provided with two spaced apart brackets 58, which may be welded to the panel, the brackets 58 in turn each mounting two coupling nuts 60. The coupling nuts are spaced apart so as to flank the channel 28 between the vertical columns. As noted above, there are at least two brackets and pairs of coupling nuts secured to the inside of cover 42 and longitudinally spaced apart thereon.

Figure 4:
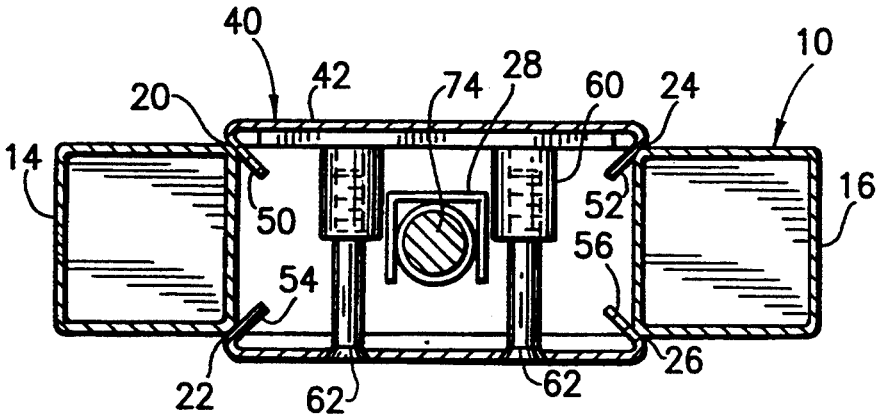
FIG. 4 is a sectional view, similar to FIG. 3 and partially fragmented, of the height adjustment mechanism of FIG. 1, taken along the lines 4—4 of FIG. 2.

Cover 46 is provided with openings in which tensioning screws 62 are inserted and the tensioning screws are received in the coupling nuts 60. The tensioning screws are tightened to draw the covers 42 and 44 together so that the in-turned marginal edges of the covers clampingly engage the friction strips 20, 22, 24 and 26 of the vertical columns. With particular reference to FIGS. 3 and 4, the in-turned marginal edge 50 of cover 42 bears against the friction strip 70 of vertical column 14, and in-turned marginal edge 52 of cover 42 bears against the friction strip 24 of vertical column 16, with cover 42 spanning the space between the two columns. Similarly, the in-turned marginal edge 54 of cover 46 bears against the friction strip 22 of vertical column 14, and in-turned marginal edge 56 of cover 46 bears against friction strip 26 of vertical column 16, with cover 46 spanning the space therebetween. The vertical columns and covers are provided with a textured powder coat finish, which provides uniform frictional engagement. The clamping of the covers against the vertical columns provides a sturdy, wobble-free support for the tabletop.

It will be appreciated that although the preferred embodiment utilizes square or rectangular vertical columns with the friction strips on the corners thereof, and covers having in-turned edges to engage the corner friction strips, other configurations may also be used to provide the desired frictional engagement between the vertical columns and covers. For instance, round posts and a pair of planar covers tensionally secured together with the edges of the covers bearing against the posts also provides frictional engagement along four friction strips. Further, the term "friction strips" as used herein does not refer to a special structure or surface, but rather to the area of engagement.

Figure 1:
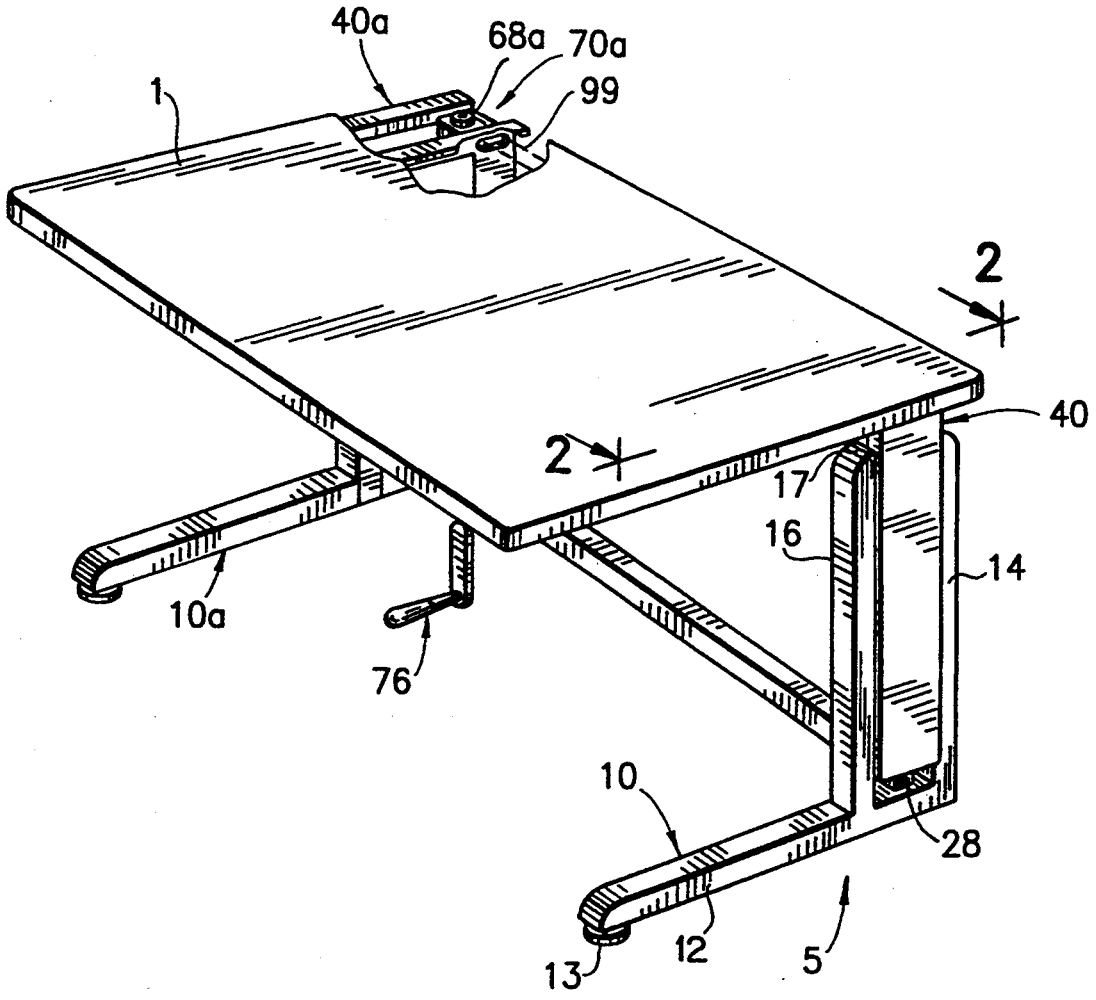
FIG. 1 is a perspective view of a height adjustment mechanism of the invention herein supporting a tabletop, with the tabletop being partially cut away to expose elements of the height adjustment mechanism.
Figure 2:
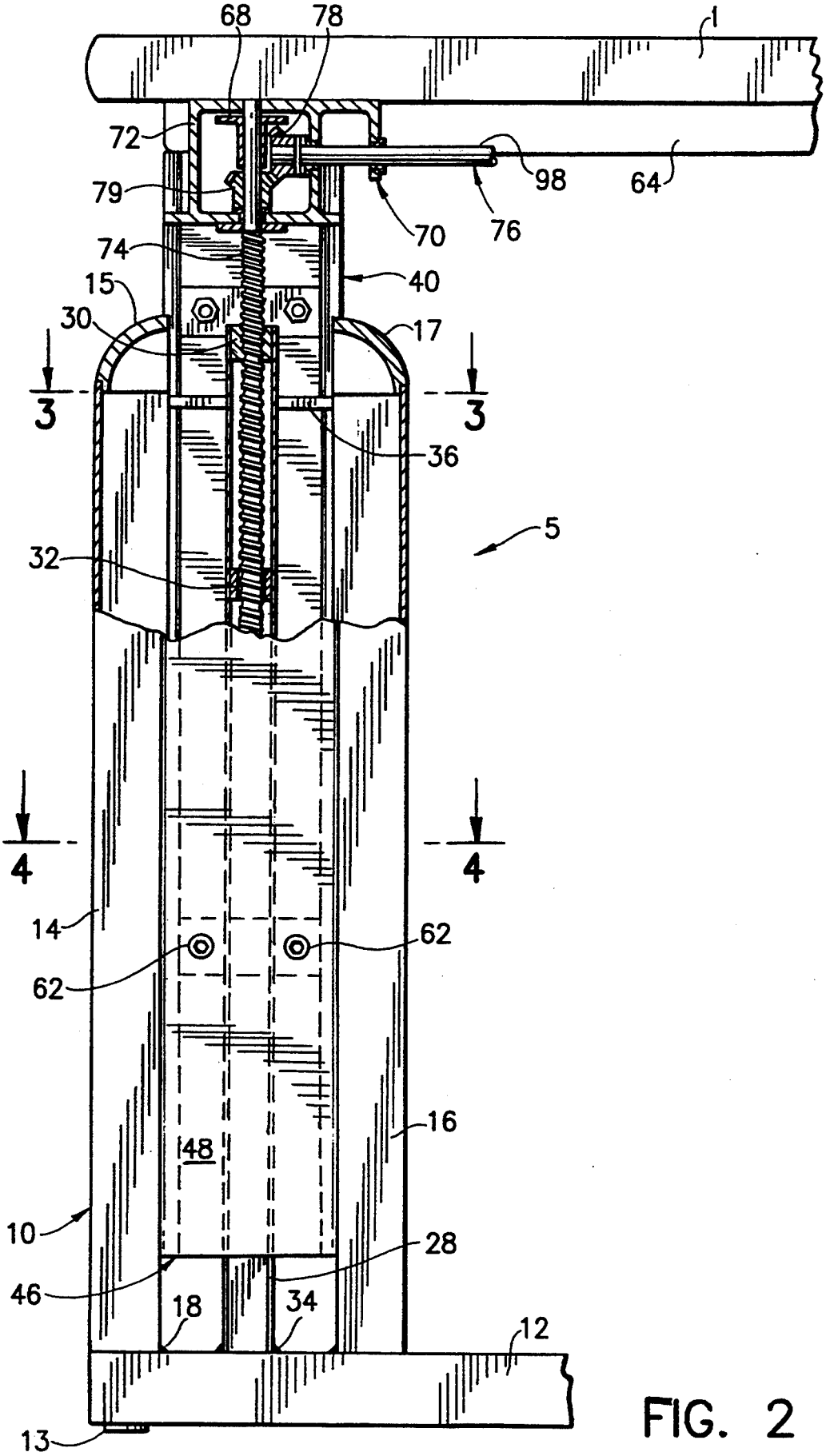
FIG. 2 is a longitudinal sectional view of the height adjustment mechanism and tabletop shown in FIG. 1, taken generally along the lines 2—2 of FIG. 1.
Figure 5:
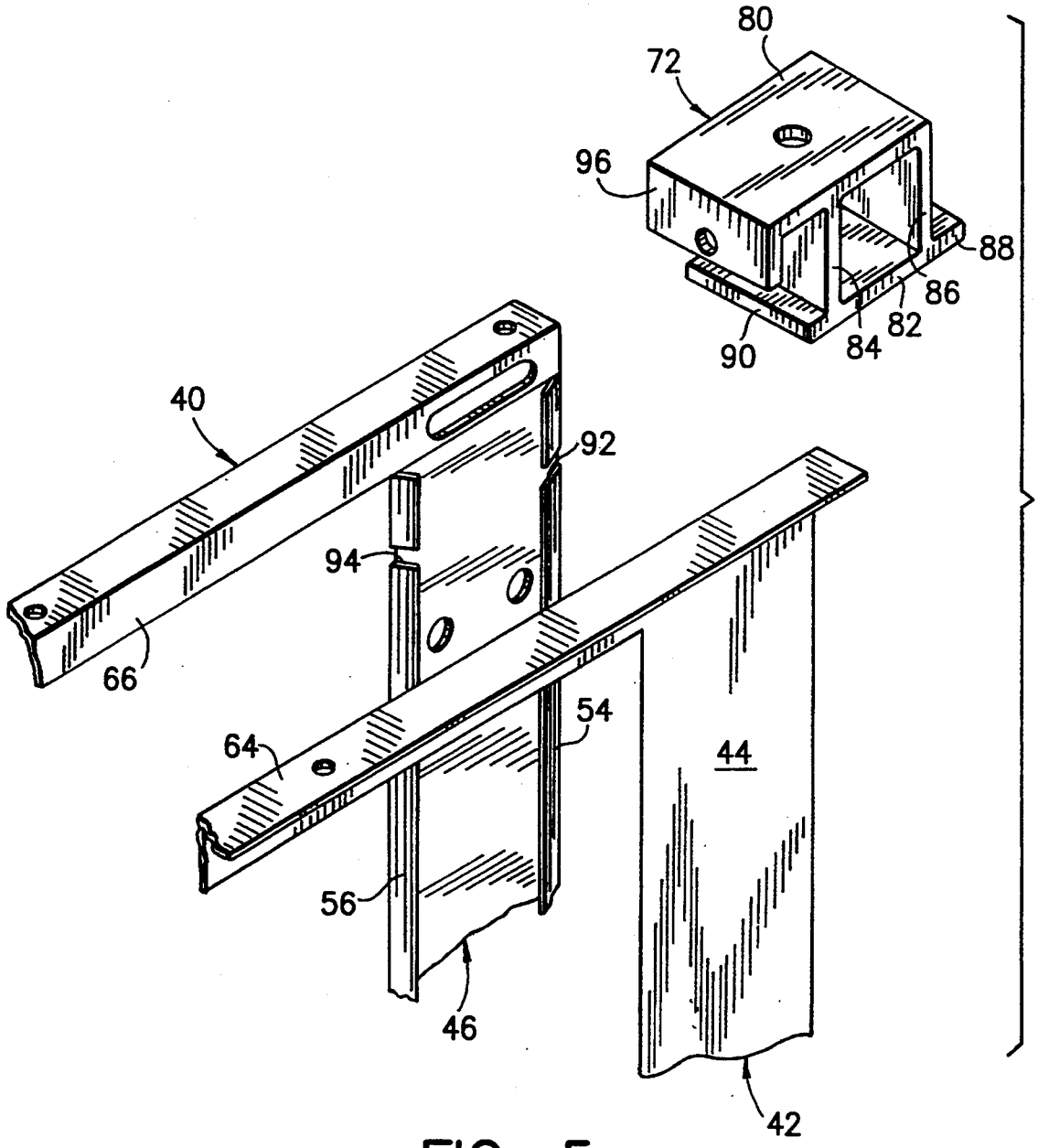
FIG. 5 is an exploded fragmentary view of the height adjustment mechanism.

As best illustrated in FIGS. 2 and 5, a pair of support arms 64 and 66 are secured to the upper ends of sliding covers 42 and 46, respectively. The support arms 64 and 66 are secured to the under side of tabletop 1, so that the slidable post assembly mounts and supports the table.

The height adjustment mechanism 5 further includes drive means 70 for driving the slidable post assembly and the table secured thereto up and down on the leg assembly among adjusted height positions. The drive means 70 generally comprises a gear box 72, a jack screw 74 depending therefrom and received in the jack nut 30 of the leg assembly 10, and a crank 76 for operating the jack screw through bevel gears 78 and 79.

As best seen in FIGS. 2 and 5, the gear box 72 has an upper plate 80, a lower plate 82 and connecting webs 84 and 86, providing a center chamber. The lower plate 82 extends past the webs 84 and 86 and terminates in flanges 88 and 90. These flanges are received in slots 92 and 94, respectively, formed in the in-turned marginal edges of cover 46, and the opposite ends of the flanges are received in similar notches in the in-turned marginal edges of cover 42. Thus, the gear box is captured and retained between the covers 46 and 42, just below the tabletop 1.

The jack screw 74 depends from the gear box 70 and is threadably received in the jack nut 30 mounted in the channel 28 of the leg assembly 10. The further depending portion of the jack screw 74 extends through bushing 32, which maintains the jack screw in the proper alignment. Within the gear box 72, bevel gear 79 is secured to the end of jack screw 74.

Upper plate 80 of the gear box 70 includes a downwardly extending flange 96 having an opening therein for accommodating the shaft of 98 of the crank 76. The end of shaft 98 is received within the gear box 70 and has bevel gear 78 secured thereto in engagement with bevel gear 79, whereby turning the crank turns the jack screw. Because the jack nut 30 is stationary within the leg assembly 10, turning the jack screw raises or lowers the sliding post assembly 40 relative to the leg assembly 10, thereby adjusting the height of the tabletop 1.

The tensioning screws 62 are adjusted to provide frictional engagement between the in-turned marginal edges of the cover and the friction strips of the vertical columns. This frictional force is overcome by turning the handle crank to adjust the height of the tabletop, but the frictional force assists in maintaining the tabletop at the adjusted height upon cessation of cranking adjustment, while the clamping action contributes to rigid, sturdy support of the tabletop.

In the preferred embodiment shown, a second leg assembly **10*a* and a second sliding post assembly 40*a* are provided at the other end of the tabletop 1. Drive means 70*a* including a gear box 72*a* and jack screw is provided at the upper end of the sliding post assembly 40*a*, and the jack screw of the drive means 70*a* is connected via a sprocket gear 68*a* and chain 99 to a sprocket gear 68 in the first drive mechanism 70**. This permits the handle crank to operate both drives simultaneously, and thereby adjust the height of the tabletop while maintaining the level attitude thereof.

Accordingly, a preferred embodiment of a height adjustment mechanism for tabletops has been described which admirably achieves the objects of the invention herein. With reference to the description of the preferred embodiment, those skilled in the art will appreciate that modifications may be made to the invention without departing from the spirit thereof. Therefore, it is not intended that the scope of the invention be limited to the specific embodiment illustrated and described. Rather, it is intended that the scope of the invention be determined by the appended claims and equivalents thereof.

We claim:

1. A height adjustment mechanism for a table, comprising:

A) at least one leg assembly including a base, two spaced-apart vertical columns upstanding from the base, the two vertical columns each having two elongated vertical friction strips, the two elongated vertical friction strips of one of the two columns juxtaposed the elongated vertical friction strips of the other of the two columns;

B) one slidable post assembly slidably mounted on each leg assembly, the slidable post assembly including a pair of opposed connected sliding covers, one cover spanning the space between the two vertical columns and engaging one elongated vertical friction strip of each column, the other cover also spanning the space between the two vertical columns opposite the first cover and engaging the other elongated vertical friction strip of each column, and means connecting and securing the pair of covers together to frictionally clamp against the frictional strips of the columns, the upper ends of the covers secured to and supporting the table; and C) drive means for driving the slidable post assembly and the table secured thereto up and down to an adjusted height, wherein the clamping frictional engagement between the covers and vertical columns provides a sturdy, rigid tabletop support and assists in holding the table at an adjusted height.

2. A height adjustment mechanism as defined in claim 1 wherein the covers have in-turned marginal edges which engage the elongated frictional strips of the vertical columns.

3. A height adjustment mechanism as defined in claim 2 wherein the vertical columns are rectangular and the vertical frictional strips are at corners of the rectangular columns.

4. A height adjustment mechanism for a table as defined in claim 3 wherein the vertical columns and inturned marginal edges of the covers are provided with a coating to achieve generally uniform frictional engagement therebetween.

5. A height adjustment mechanism as defined in claim 3 wherein the covers are secured together by adjustable fasteners, whereby the frictional clamping force of the covers against the frictional strips of the vertical posts is adjustable.

6. A height adjustment mechanism as defined in claim 5 wherein the adjustable fasteners are threaded fasteners.

7. A height adjustment mechanism as defined in claim 6 wherein the adjustable fasteners comprise a bracket secured to one cover, at least one coupling nut secured to each bracket and a threaded fastener inserted through an opening in the opposed- panel and received in the coupling nut, said fastener having a head engaging the cover through which it is inserted.

8. A height adjustment mechanism as defined in claim 1 wherein the covers are secured together by adjustable fasteners, whereby the frictional clamping force of the covers against the frictional strips of the vertical posts is adjustable.

9. A height adjustment mechanism as defined in claim 1 wherein the drive means includes a jack screw mounted to one of the leg assembly or slidable post assembly and a jack nut secured to the other of the leg assembly or slidable post assembly and threadably receiving the jack screw, and means for rotating the jack screw relative to the jack nut to adjust the height of the tabletop.

10. A height adjustment mechanism as defined in claim 9 wherein the jack nut is mounted in a channel disposed between the vertical columns and covers, and the jack screw threaded through the jack nut and is also received in the channel.

11. A height adjustment mechanism as defined in claim 10 wherein the channel is mounted to the leg assembly and the jack screw is mounted to the sliding post assembly.

12. A height adjustment mechanism as defined in claim 11 wherein the jack screw is driven by a gear box mounted between the upper ends of the covers under the tabletop.

13. A height adjustment mechanism as defined in claim 12 wherein the drive means further includes a crank having a first bevel gear thereon for driving a second bevel gear connected to the jack screw within the gear box.

14. A height adjustment mechanism as defined in claim 12 wherein the gear box includes mounting flanges and the covers define slots receiving the mounting flanges of the gear box for mounting the gear box between the covers when the covers are connected together.

15. A height adjustment mechanism as defined in claim 1 wherein the at least one leg assembly comprises two leg assemblies, each having a sliding post assembly mounted thereon and drive means, and the two leg assemblies and cooperating sliding post assemblies are spaced apart to support the tabletop.

16. A height adjustment mechanism as defined in claim 15 wherein the drive means of both the two leg assemblies and slidable post assemblies are interconnected.

17. A height adjustment mechanism as defined in claim 16 wherein the drive means of the first leg assembly and slidable post assembly includes a jack screw mounted to one of the leg assembly or slidable post assembly and a jack nut secured to the other of the leg assembly or slidable post assembly and threadably receiving the jack screw, and the drive means of the second leg assembly and slidable post assembly also includes a jack screw and jack nut similarly mounted, and the jack screws are connected for concurrent rotation.

18. A height adjustment mechanism as defined in claim 17 wherein the jack screws are mounted to the slidable cover assemblies.

19. A height adjustment mechanism as defined in claim 18 wherein one of the jack screws is driven by a crank and connected to the other jack screw by a sprocket and chain drive.

20. A height adjustable table comprising:

A) a tabletop;

B) two leg assemblies, each leg assembly including a base, two spaced-apart rectangular vertical columns upstanding from the base, the two vertical columns each having two elongated vertical friction strips at the corners thereof, the two elongated vertical friction strips of one of the two columns juxtaposed the elongated vertical friction strips of the other of the two columns, and a channel mounted to and upstanding from the base between the vertical columns;

C) two slidable post assemblies, one slidable post assembly associated with each leg assembly, respectively, each slidable post assembly including a pair of opposed connected sliding covers, one cover spanning the space between the associated two vertical columns and having in-turned marginal edges engaging one elongated vertical friction strip of each column, the other cover also spanning the space between the associated two vertical columns opposite the first cover and having in-turned marginal edges engaging the other elongated vertical friction strip of each column, and means connecting and securing the pair of covers together to frictionally clamp against the friction strips of the associated columns, the upper ends of the covers secured to and supporting the tabletop, and D) drive means for driving the slidable post assemblies and the tabletop secured thereto up and down to an adjusted height, the drive means including one jack screw mounted to each slidable post assembly and extending downwardly in the channel mounted to the base, a jack nut secured in each channel and threadably receiving the jack screw received in the channel, and means for coordinated rotation of the two jack screws to place the tabletop at an adjusted height, wherein the frictional engagement between the covers and vertical columns assists in holding the tabletop at the adjusted height.

* * * * *